US005465520A

United States Patent [19]

Cupp

[11] Patent Number: 5,465,520

[45] Date of Patent: Nov. 14, 1995

[54] GUN GRIP

[75] Inventor: Carl J. Cupp, Hawaiian Garden, Calif.

[73] Assignee: Pachmayr Ltd., Monrovia, Calif.

[21] Appl. No.: 330,270

[22] Filed: Oct. 27, 1994

[51] Int. Cl.[6] ..... F41C 23/10

[52] U.S. Cl. ..... 42/71.02

[58] Field of Search ..... 42/71.02, 74

[56] References Cited

U.S. PATENT DOCUMENTS

| | | | |
|---|---|---|---|
| 2,308,627 | 1/1943 | Rickenbacher | 42/71.02 |
| 3,672,084 | 6/1972 | Pachmayr | 42/71.02 |
| 3,815,270 | 6/1974 | Pachmayr | 42/71.02 |
| 4,043,066 | 8/1977 | Pachmayr et al. | 42/71.02 |
| 4,132,024 | 1/1979 | Pachmayr et al. | 42/71.02 |
| 4,221,066 | 9/1980 | Hillberg | 42/71.02 |
| 4,286,401 | 9/1981 | Pachmayr et al. | 42/71.02 |
| 4,315,379 | 2/1982 | Lang | 42/71.02 |
| 4,359,833 | 11/1982 | Pachmayr et al. | 42/71.02 |
| 4,378,651 | 4/1983 | Pachmayr et al. | 42/71.02 |
| 4,771,562 | 9/1988 | Ruger | 42/71.02 |
| 5,231,237 | 7/1993 | Cupp | 42/71.02 |

*Primary Examiner*—Charles T. Jordan
*Assistant Examiner*—Theresa M. Wesson
*Attorney, Agent, or Firm*—William P. Green

[57] ABSTRACT

A gun grip assembly including two body panels to be received at the opposite sides of a gun handle, and two outer grip panels to be received at the outer sides of the two body panels respectively and preferably forming side portions of a grip unit having a connecting portion extending between and interconnecting the two side portions. The side portions of the grip unit are attached to the two body panels respectively, and the body panels contain openings at locations offset from/the side portions of the grip unit to receive threaded fasteners which extend through the body panels but not through the side portions of the grip unit and which tighten the body panels against the opposite sides of the handle.

21 Claims, 3 Drawing Sheets

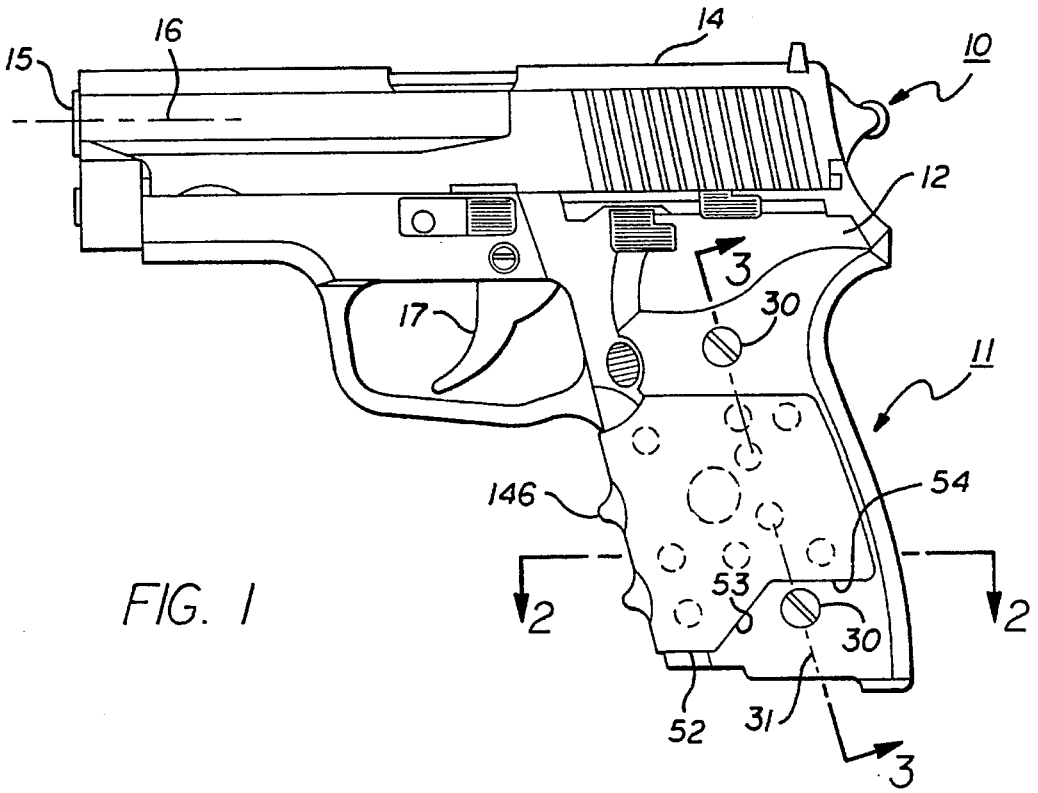
FIG. 1
FIG. 2
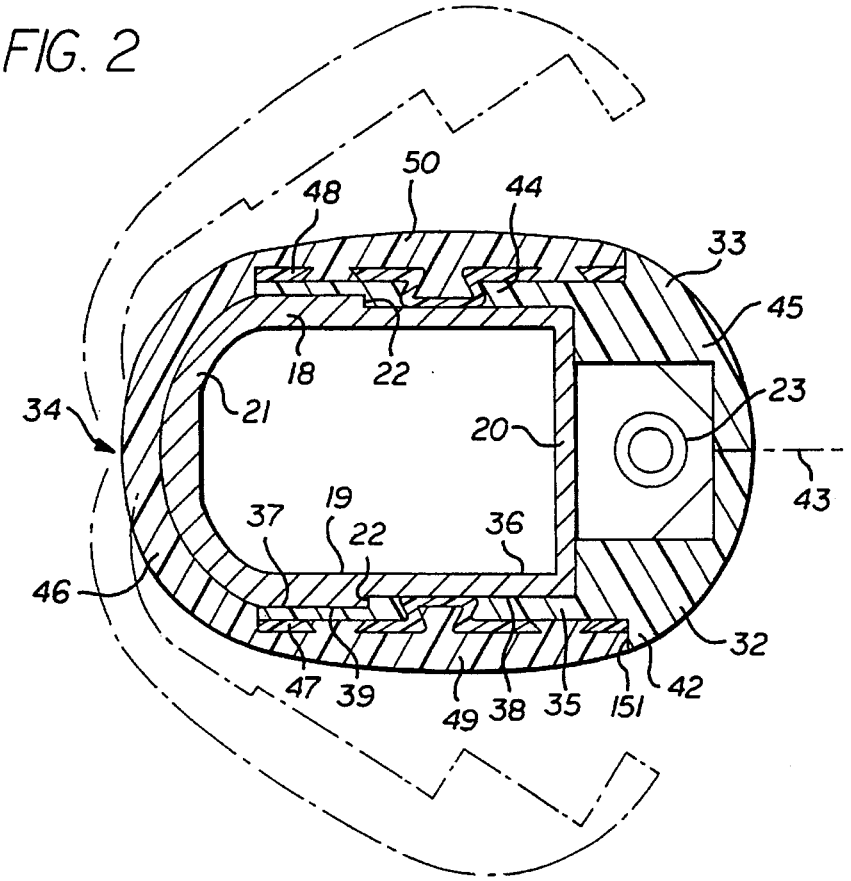

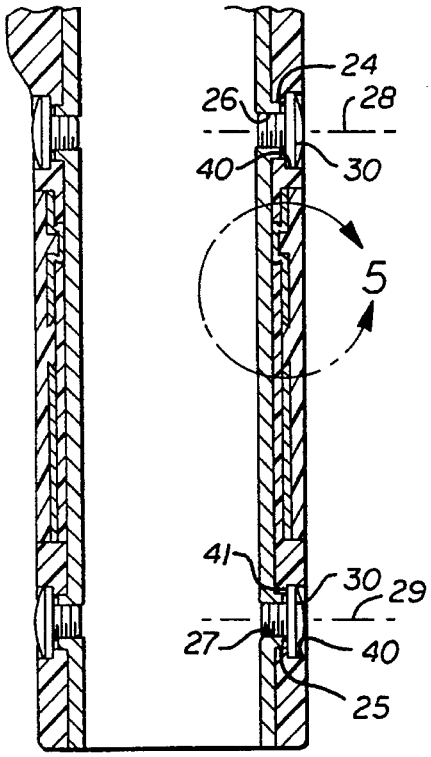
FIG. 3
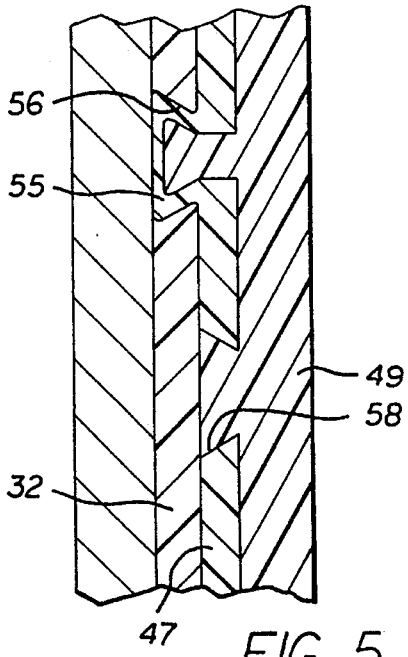
FIG. 5
FIG. 4
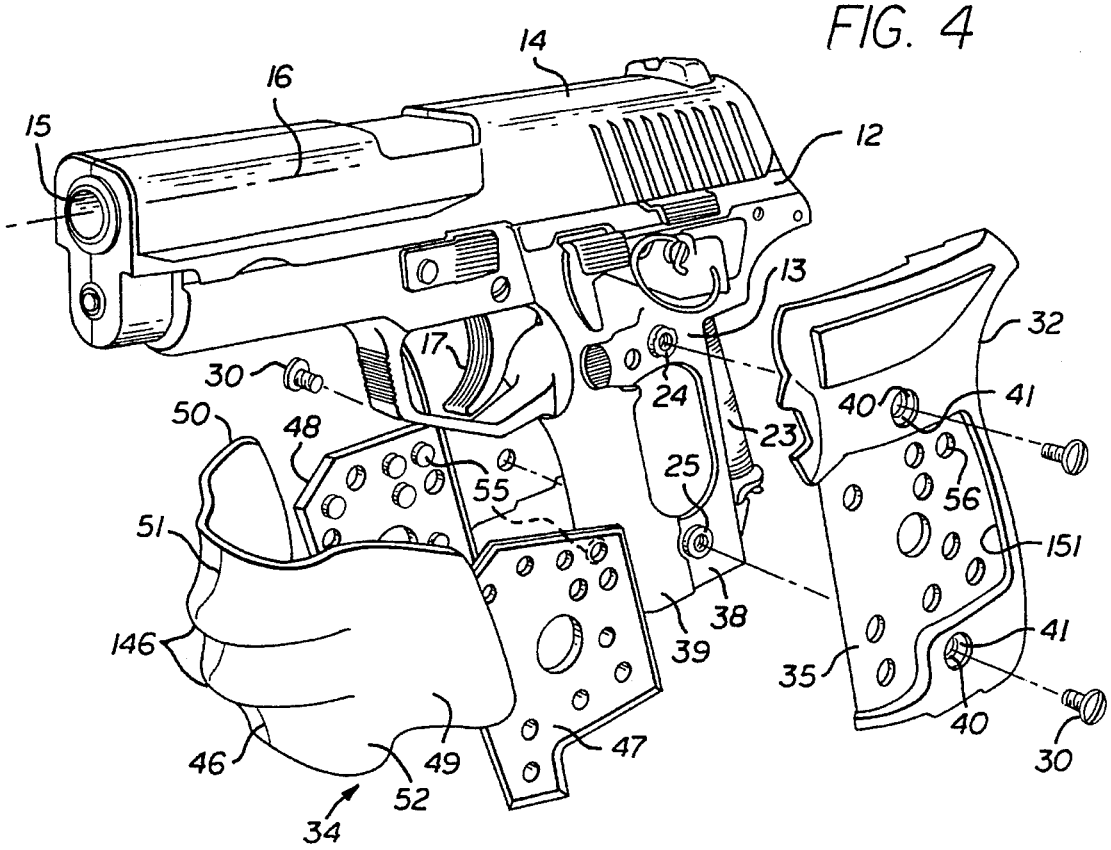

GUN GRIP

BACKGROUND OF THE INVENTION

The grips of the present invention are of a general type including a first pair of panels which are received at opposite sides of the handle of a gun and which may be referred to as body panels, and two additional panels received at outer sides of the two body panels respectively and which may be formed at least in part of elastomeric material to cushion the contact of a user's hand with the overall grip assembly. These outer panels may be side portions of a grip unit having a connecting portion extending between and interconnecting the side portions or panels. A prior art grip having these features is shown in U.S. Pat. No. 5,231,237 issued. Jul. 27, 1993 to Carl J. Cupp on "Gun Grip Assembly". In that patent, the connecting portion of the grip unit extends across the front of the gun handle, and is attached to the body panels of the device by screws extending through the side portions of the grip unit and connected threadedly to the body panels.

SUMMARY OF THE INVENTION

A major purpose of the present invention is to provide an improved grip assembly having body panels and a grip unit as discussed, but in which the parts are so designed that the same grip unit may be utilized on any of a number of different types of guns, with only the body panels being changed to conform to the different guns. The body panels are secured to a gun by screws which extend through only those body panels themselves, and which are offset from and do not extend through the side portions of the grip unit. The grip unit therefore does not require any change in design in order to adapt the overall assembly for use on guns having grip attaching screws at different locations. Such use of the same grip unit for several different types of guns, with only the body panels varying for the different guns, reduces the cost and complexity of the manufacturing process, and reduces the number of different types of parts which must be kept in stock by a manufacturer or seller.

The body panels are preferably attached to the grip unit in a manner allowing handling of the grip unit and panels together as an interconnected assembly during attachment to and detachment from a gun handle. This connection between the grip unit and body panels is preferably attained by providing the elastomeric material of the side portions of the grip unit with reinforcing plates which interfit with and are connected to the body panels. The reinforcing plates may have projections extending into openings in the body panels and retained therein by welding, upsetting or the like to secure the parts together.

BRIEF DESCRIPTION OF THE DRAWINGS

The above and other features and objects of the invention will be better understood from the following detailed description of the typical embodiments illustrated in the accompanying drawings, in which:

FIG. 1 is a side elevational view of a gun to which a grip assembly embodying the present invention has been attached;

FIG. 2 is an enlarged horizontal section taken on line 2—2 of FIG. 1;

FIG. 3 is an enlarged fragmentary generally vertical section taken on line 3—3 of FIG. 1;

FIG. 4 is an exploded perspective view showing the gun of FIG. 1 and the various parts of which the grip of the present invention is constructed;

FIG. 5 is a further enlarged fragmentary section corresponding to the portion of FIG. 3 contained within the circle identified by the number 5;

DESCRIPTION OF THE PREFERRED EMBODIMENTS

Figure 6:
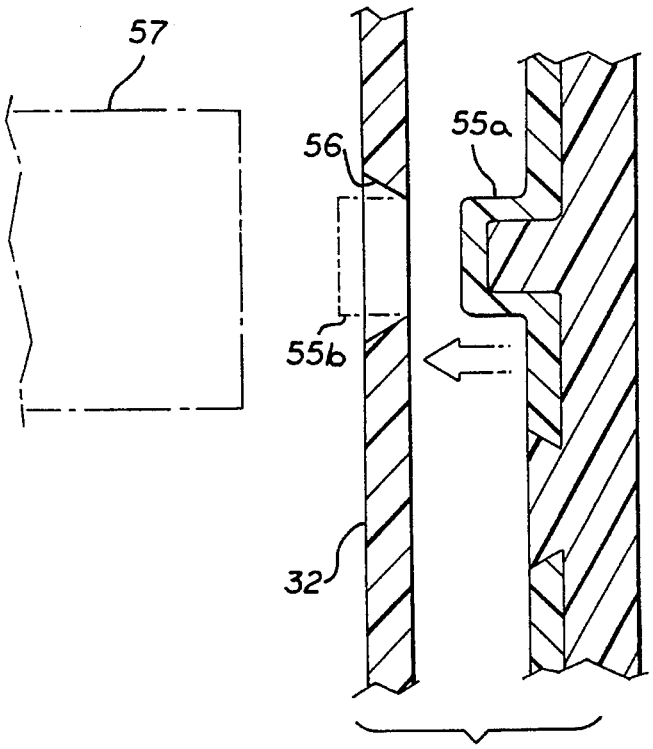
FIG. 6 is a fragmentary view showing the manner in which the parts illustrated in FIG. 5 may be connected together.

There is illustrated at 10 in FIG. 1 a pistol having a grip assembly 11 embodying the invention. As seen best in the exploded perspective view of FIG. 4, the pistol has a main frame 12 with a downwardly projecting portion 13 forming a handle of the gun to which grip assembly 11 is mounted. The upper portion of the frame may carry a slide 14 which contains the barrel 15 of the gun and which recoils relative to the frame essentially parallel to the axis 16 of the barrel upon firing of the gun. The usual trigger 17 controls firing.

The downwardly projecting handle 13 of the gun may have the horizontal cross section illustrated in FIG. 2, with that cross section being defined by two parallel opposite side walls 18 and 19, a transverse planar rear wall 20, and a rounded front wall 21. The side walls 18 and 19 may be of reduced thickness rearwardly beyond the location 22 of FIG. 2. The usual hammer spring 23 may extend generally vertically behind handle 13.

Each of the side walls 18 and 19 of the gun handle 13 has grip attaching portions 24 and 25 projecting laterally outwardly a short distance and containing internally threaded bores 26 and 27 centered about two vertically spaced horizontal axes 28 and 29 (see FIG. 3) for reception of screws 30 by which the grip is attached to the handle of the gun. As will be apparent from FIG. 1, the axes 28 and 29 of screws 30 lie slightly inclined generally vertical plane 31.

The grip assembly 11 shown in FIGS. 1 through 6 of the drawings includes two side panels 32 and 33 and a forward grip unit 34 interconnecting the side panels and forming a cushion for engaging the user's hand at the front and sides of the handle. The two side panels 32 and 33 are preferably essentially rigid, and may be molded of an appropriate resinous plastic material, such as polypropylene, desirably shaped to have the horizontal cross sectional configuration illustrated in FIG. 2. More particularly, panel 32 has a vertically extending portion 35 with vertical planar inner surfaces 36 and 37 engaging the correspondingly vertical planar outer surfaces 38 and 39 of gun handle 13, and urged thereagainst by tightening of screws 30. These screws extend through openings 40 formed in side panel 32 and aligned with threaded bores 26 and 27 of the gun handle with the heads of screws 30 acting against shoulders 41 formed in the side panel 32 to retain the side panel against the handle. At the rear of the gun, side panel 32 has a portion 42 which curves inwardly about hammer spring 23, to enclose that spring and meet the opposite side panel 33 in a vertical plane 43 at the back of the gun.

The second side panel 33 is essentially a mirror image of panel 32, having a forwardly extending portion 44 tightenable against the right side of the gun handle by two of the screws 30, and having a rear portion 45 curving inwardly about the hammer spring as shown in FIG. 2.

The forward grip unit 34 includes a main body 46 molded of resiliently deformable elastomeric material and two reinforcing plates 47 and 48 bonded to the elastomeric body and formed of a material which is harder than the elastomeric material and is preferably rigid. The elastomeric body may be formed of neoprene rubber, typically having a Shore hardness between about 40 and 50 on the A scale. The reinforcing plates 47 and 48 may be formed of any suitable stiff material, preferably a rigid resinous plastic material. A presently preferred material is the plastic alloy marketed by General Electric under the trademark "Xenoy". Alternatively, plates 47 and 48 may be formed of metal if desired.

The elastomeric body 46 of grip unit 33 is shaped to have two side portions 49 and 50 which are received at the outer sides of the previously described body panels 32 and 33 of the grip assembly, and which are connected together by a forward portion 51 of elastomeric body 46 extending about and curving in correspondence with the front curved wall 21 of the handle body. Reinforcing plates 47 and 48 are bonded to the inner surfaces of portions 49 and 50 of the elastomeric body, and are permanently connected to side panels 32 and 33 to form those panels and the forward grip unit 34 into an integrated assembly adapted to be applied to and detached from the gun handle as a unit. The forward portion 51 of elastomeric body 46 may have vertically spaced horizontal ribs 146 projecting forwardly from its front surface to define horizontal grooves for receiving a user's fingers when gripping the gun.

Side portions 49 and 50 of the elastomeric body 46 of forward grip unit 34 may be given the outline configuration illustrated in FIG. 1, with the plates 47 and 48 at the inner sides of these side portions of the elastomeric body having a similar configuration. Portions 49 and 50 and their reinforcing plates are received within recesses 151 formed in the outer sides of panels 32 and 33 and shaped in correspondence with the side portions of the grip unit. The configuration of these side portions 49 and 50 and their reinforcing plates 47 and 48 is such as to cover only part of each side panel 32 or 33, and in particular to avoid covering portions of the panel at which screws 30 extend through the panels for connection to the gun handle. The screws thus do not extend through any part of forward grip unit 34, but only extend through the side panels 32 and 33. To describe the outline configuration of the side portions of grip unit 34 somewhat more specifically, it is noted that those side portions may extend downwardly farther at the front of the gun than near the rear of the gun. More particularly, the bottom edges 52 of the side portions of grip unit 34 may be inclined upwardly at 53 and then horizontally at 54 to define a recess avoiding contact with the lower of the two grip attaching screws 30 at each side of the gun. The two screws 30 are thus located above and beneath the side portions of grip unit 34.

The connection between reinforcing plates 47 and 48 of the forward grip unit 34 and side panels 32 and 33 is preferably attained by providing reinforcing plates 47 and 48 with projections 55 which extend into openings 56 formed in panels 32 and 33, and which are upset to form heads at the inner sides of panels 32 and 33 locking the parts together (see FIG. 5). The projections 55 may initially have the essentially cylindrical configuration illustrated at **55*a* in FIG. 6, with the openings 56 having the tapering or countersunk configuration illustrated in that figure and being dimensioned so that the cylindrical projections may extend into and project slightly beyond the inner surface of panel 32 or 33, as to the position represented in broken lines at 55*b* in FIG. 6. After the plate has been moved into close abutting engagement with panel 32 or 33, a heated iron 57 may be moved into contact with the end of projections 55 to partially melt or soften those projections and deform them to the flaring configuration illustrated in FIG. 5, forming a head fitting the flaring opening 56 and locking the parts together. Alternatively, the head 57 may be an ultrasonicly driven element acting to cause the same type of upsetting of the projections 55*a*, or may be a spinning head serving to upset the projections. In addition to the projections 55*a*, reinforcing plates 47 and 48 may also contain a number of openings 58 which may be flared as shown and into which the elastomeric material of body 47** may extend to enhance the bond formed between that elastomeric material and the reinforcing plates.

In manufacturing the grip unit illustrated in FIGS. 1 through 6, the first step may be to mold side panels 32 and 33 and reinforcing plates 47 and 48 to the illustrated configurations, after which the elastomeric material of body 46 of forward grip unit 34 may be molded to shape with reinforcing plates 47 and 48 contacting the elastomeric material during the molding process and thus being bonded tightly thereto. The grip unit 34, including its elastomeric body 46 and carried reinforcing plates 47 and 48 may then be moved into contact with side panels 32 and 33, with the side portions of unit 34 being received within recesses 151 of the side panels, and with the parts being pressed together so that all of the projections **55*a* of the reinforcing plates extend into the openings 56 of the side panels. While the parts are held together in this relation, an ultrasonic or other welding or upsetting head as represented diagrammatically at 57 in FIG. 6 is brought into contact with the projections 55*a* to deform them to the condition illustrated in FIG. 5. This locks all of the parts together, so that the side panels 32 and 33 and the forward grip unit 34 including its elastomeric body 46 and side plates 47 and 48 may thereafter be attached to and detached from the gun handle as a unitary assembly. To attach the assembly to the gun handle, the forward part of unit 34 is brought into engagement with the front wall 21 of the gun handle, and the two side panels 32 and 33 with their connected side portions of unit 34 are then swung inwardly from the broken line positions of FIG. 2 to the full line positions of that figure to engage the opposite sides of the gun handle and allow attachment of panels 32 and 33 to the gun handle by screws 30**.

Figure 7:
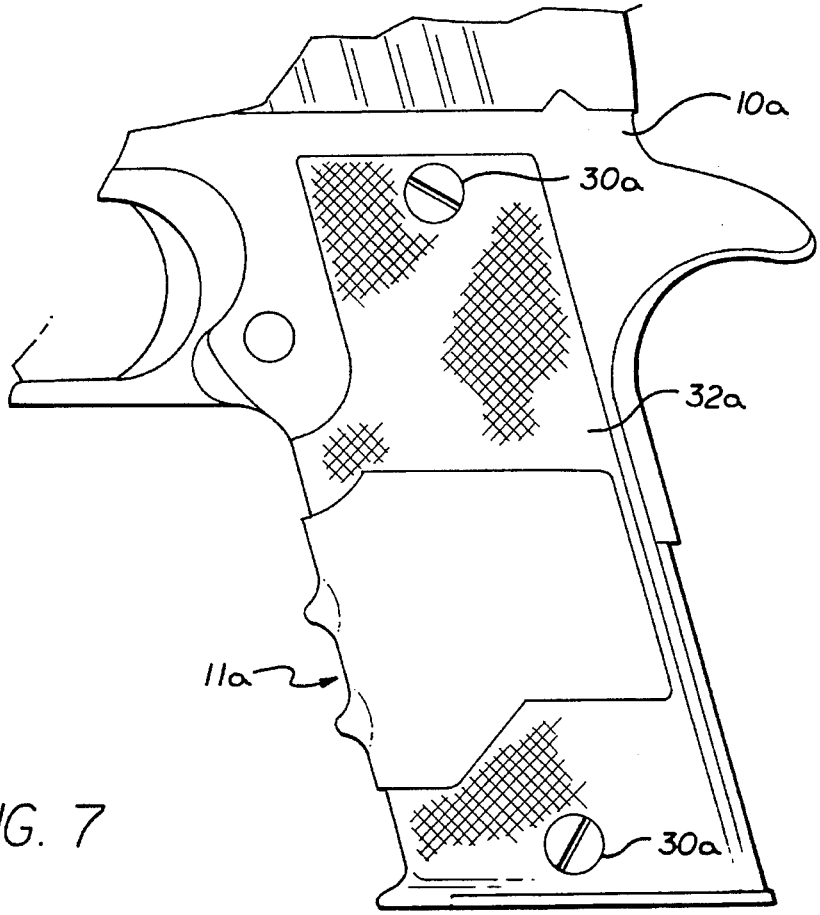
FIG. 7 is a view similar to FIG. 1 showing a grip embodying the invention applied to a different type of gun, with the grip including the same forward grip unit as in the FIG. 1 arrangement but having different side panels attached to that grip unit.

FIG. 7 illustrates a variational type of grip assembly **11*a* which utilizes the same forward grip unit 34 as has been described in connection with FIGS. 1 through 6, but which has been adapted for application to a gun 10*a* which is somewhat different than that shown at 10 in FIG. 1. To enable use of the grip assembly on the gun 10*a*, the assembly 11*a* of FIG. 7 includes side panels 32*a* similar to the panels 32 and 33 of FIGS. 1 to 6 but shaped differently to fit the handle of the gun 10*a* rather than that of FIG. 1. These two side panels 32*a* are retained by screws 30*a* similar to screws 30 of FIG. 1, but positioned differently in accordance with the mating screw-receiving bores of the particular gun 10*a*. For example, the two screws 30*a* may be spaced farther apart than the screws 30 of FIG. 1. The panels 32*a* may also be changed in any other respects necessary to properly conform to the configuration of the handle of gun 10*a* and to avoid interference with any of the operating mechanism of that gun. As in the first form of the invention, the side portions of grip unit 34 cover only a portion of each of the side panels 32*a*, and do not cover or interfere with the locations of screws 30***a*. Unit 34 has the same reinforcing plates 47 and 48 as in the first form of the invention, with those plates being provided with the projections 55 extending through openings in side panels 32*a* and secured rigidly thereto by welding or upsetting as discussed in connection with FIGS. 5 and 6.

In this manner, the same forward grip unit 34 may be utilized in connection with several different types of side panels applicable to several different types or makes of guns, all of which have openings for passing screws 30, 30*a*, etc. through the side panels at locations offset from the side portions of unit 34 and thus not interfering there-with.

While certain specific embodiments of the present invention have been disclosed as typical, the invention is not limited to these particular forms, but rather is applicable broadly to all such variations as fall within the scope of the appended claims.

I claim:

1. A grip assembly for a gun having a downwardly projecting handle, comprising:

two body panels to be received at opposite sides of the handle;

a grip unit having two side portions to be received at outer sides of said two body panels respectively, and having a connecting portion extending between and interconnecting said side portions; and means for securing said side portions of the grip unit to said two body panels respectively;

said body panels containing openings at locations offset from said side portions of the grip unit for receiving threaded fasteners which extend through said body panels but not through said side portions of the grip unit and which tighten said body panels against said opposite sides of the handle.

2. A grip assembly as recited in claim 1, in which said connecting portion of said grip unit is received in front of said handle of the gun.

3. A grip assembly as recited in claim 1, in which said grip unit is formed at least in part of resiliently deformable elastomeric material.

4. A grip assembly as recited in claim 1, in which each of said body panels contains two of said openings at locations essentially above and beneath a corresponding one of said side portions of the grip unit for receiving separate threaded fasteners acting to tighten the body panel against the handle both above and beneath said side portion of the grip unit.

5. A grip assembly as recited in claim 1, in which said side portions of the grip unit are formed in part of deformable elastomeric material containing reinforcing plates stiffer than said elastomeric material, and said connecting portion of the grip unit is formed of deformable elastomeric material.

6. A grip assembly as recited in claim 5, in which said connecting portion of said grip unit is received in front of said handle of the gun.

7. A grip assembly as recited in claim 5, in which said reinforcing plates are bonded to inner sides of said elastomeric material of the side portions of the grip unit.

8. A grip assembly as recited in claim 7, in which said reinforcing plates contain openings into which said elastomeric material extends to enhance the bond with the plates.

9. A grip assembly for a gun having a downwardly projecting handle, comprising:

two body panels to be received at opposite sides of the handle;

a grip unit having two side portions to be received at outer sides of said two body panels respectively, and having a forward portion receivable in front of the handle and extending between and interconnecting said side portions of the grip unit;

said side portions of the grip unit being dimensioned to only partially cover the outer sides of said body panels, and being formed partially of resiliently deformable elastomeric material softer than said body panels and bonded to reinforcing plates stiffer than said elastomeric material;

said forward portion of the grip unit being formed of elastomeric material molded integrally with the elastomeric material of said side portions of the grip unit;

said reinforcing plates having projections extending inwardly toward the gun handle into interfitting openings in said body panels and retained therein to attach the panels and grip unit together for detachment from the handle as an interconnected assembly;

said body panels containing openings at locations offset from said side portions of the grip unit; and threaded fasteners to extend through said openings in the body panels at said locations offset from said side portions of the grip unit for tightening said body panels against said opposite sides of the handle.

10. A grip assembly as recited in claim 9, in which said reinforcing plates and said panels are formed of resinous plastic material and are welded together at the locations of said projections.

11. A grip assembly as recited in claim 9, in which said projections have enlarged heads at inner sides of said panels retaining the projections against removal from the openings within which they are received.

12. A grip assembly for a gun having a downwardly projecting handle, comprising:

two body panels to be received adjacent opposite sides of the handle;

a grip unit having two side portions formed at least partially of resiliently deformable elastomeric material to be received at outer sides of said two body panels respectively, and having a connecting portion extending between and interconnecting said side portions of the grip unit; and means securing said side portions of the grip unit to said two body panels respectively in a relation enabling handling of the grip unit and panels together as an interconnected assembly during attachment to and detachment from the gun handle;

said side portions of the grip unit including reinforcing plates stiffer than said elastomeric material; and said securing means including projections extending into and retained within interfitting openings to secure the panels to the reinforcing plates.

13. A grip assembly for a gun having a downwardly projecting handle, comprising:

two body panels to be received adjacent opposite sides of the handle;

a grip unit having two side portions formed at least partially of resiliently deformable elastomeric material to be received at outer sides of said two body panels respectively, and having a connecting portion extending between and interconnecting said side portions of the grip unit; and means securing said side portions of the grip unit to said two body panels respectively in a relation enabling handling of the grip unit and panels together as an interconnected assembly during attachment to and detachment from the gun handle;

said side portions of the grip unit including reinforcing plates stiffer than said elastomeric material; and said securing means including projections formed on said reinforcing plates and extending into and retained within interfitting openings in said panels.

14. A grip assembly for a gun having a downwardly projecting handle, comprising:

two body panels to be received adjacent opposite sides of the handle;

a grip unit having two side portions formed at least partially of resiliently deformable elastomeric material to be received at outer sides of said two body panels respectively, and having a connecting portion extending between and interconnecting said side portions of the grip unit; and means securing said side portions of the grip unit to said two body panels respectively in a relation enabling handling of the grip unit and panels together as an interconnected assembly during attachment to and detachment from the gun handle;

said side portions of the grip unit including reinforcing plates molded of resinous plastic material stiffer than said elastomeric material;

said securing means including projections molded integrally with said reinforcing plates and projecting inwardly therefrom toward said handle into interfitting openings formed in said panels and retained therein.

15. A grip assembly as recited in claim 14, in which said projections are welded to said panels.

16. A grip assembly as recited in claim 14, in which said projections have enlarged heads at inner sides of said panels retaining the projections against removal from the openings.

17. A grip assembly for a gun having a downwardly projecting handle, comprising:

two body panels to be received adjacent opposite sides of the handle;

a grip unit having two side portions formed at least partially of resiliently deformable elastomeric material to be received at outer sides of said two body panels respectively, and having a connecting portion extending between and interconnecting said side portions of the grip unit; and means securing said side portions of the grip unit to said two body panels respectively in a relation enabling handling of the grip unit and panels together as an interconnected assembly during attachment to and detachment from the gun handle;

said body panels containing openings at locations offset from said side portions of the grip unit for receiving threaded fasteners which extend through said body panels but not through said side portions of the grip unit and which tighten said body panels against said opposite sides of the handle.

18. A grip assembly for a gun having a downwardly projecting handle, comprising:

two body panels to be received at opposite sides of the handle;

a grip unit having two side portions to be received at outer sides of said two body panels respectively, and having a connecting portion extending between and interconnecting said side portions; and means for securing said side portions of the grip unit to said two body panels respectively;

at least one of said body panels containing an opening for receiving a threaded fastener which extends through said one body panel but not through a corresponding one of said side portions of the grip unit and which tightens said one body panel against a side of the handle.

19. A grip assembly as recited in claim 18, in which said connecting portion of said grip unit is received in front of said handle of the gun.

20. A grip assembly as recited in claim 19, in which said side portions and said connecting portion of the grip unit are all formed at least in part of resiliently deformable elastomeric material.

21. A grip assembly as recited in claim 20, in which both of said body panels contain openings for receiving a threaded fastener extending therethrough but not through said side portions of the grip unit and which tighten said body panels against opposite sides of the handle.

* * * * *